United States Patent [19]

Campbell et al.

[11] Patent Number: 4,700,196

[45] Date of Patent: Oct. 13, 1987

[54] HIGHLY DECOUPLED COSITED ANTENNAS

[75] Inventors: Donn V. Campbell, Poway, Calif.; Palemon W. Dubowicz, Eatontown; Robert T. Hoverter, Neptune, both of N.J.

[73] Assignee: The United States of America as represented by the Secretary of the Army, Washington, D.C.

[21] Appl. No.: 892,015

[22] Filed: Aug. 1, 1986

[51] Int. Cl.[4] ..... H01Q 21/26

[52] U.S. Cl. ..... 343/797; 343/808; 343/820

[58] Field of Search ..... 343/797, 808, 820, 751

[56] References Cited

U.S. PATENT DOCUMENTS

| | | | |
|---|---|---|---|
| 2,229,733 | 1/1941 | Goldmann | 343/820 |
| 2,625,655 | 1/1953 | Middlemark | 343/797 |
| 2,709,219 | 5/1955 | Schmidt | 343/820 |
| 3,879,735 | 4/1975 | Campbell et al. | 343/792 |
| 4,149,170 | 4/1979 | Campbell et al. | 343/885 |

FOREIGN PATENT DOCUMENTS

| | | | |
|---|---|---|---|
| 513624 | 6/1955 | Canada | 343/797 |

OTHER PUBLICATIONS

Arnold; *Communications;* vol. AP-18, No. 5; Sep. 1970; pp. 697, 698.

*Primary Examiner*—William L. Sikes
*Assistant Examiner*—Robert E. Wise
*Attorney, Agent, or Firm*—Sheldon Kanars; Jeremiah G. Murray; John K. Mullarney

[57] ABSTRACT

Two cosited omnidirectional biconical antennas are respectively tilted plus and minus 45 degrees (±45°) with respect to the vertical and, therefore, are perpendicular (90°) with respect to each other to effect polarization mismatch and near field decoupling. In combination with the described antennae orientation, high impedance cable chokes are added in series with the coaxial cable antennae feed lines to suppress induced parasitic rf currents.

6 Claims, 10 Drawing Figures

HIGHLY DECOUPLED COSITED ANTENNAS

The invention described herein may be manufactured, used and licensed by or for the Government for governmental purposes without the payment to us of any royalties thereon.

TECHNICAL FIELD

The present invention relates to the field of radio communication antennas and, more particularly, to highly isolated collocated omnidirectional antennas.

BACKGROUND OF THE INVENTION

The performance of a duplex radio communication system may be impaired and unpredictable unless the mutual coupling between its cosited or collocated antennas is minimized.

For a given separation, it is well known that colinear antennas provide greater interantenna isolation than parallel side-by-side antennas. For example, colinear dipoles separated by 1.5 wavelengths will provide 35 decibels isolation. On the other hand, a separation of 7 wavelengths would be required to obtain 35 decibels isolation with the parallel side-by-side antenna arrangement.

By providing enough spacing, interantenna isolation can, in principle, be reduced to an acceptable level as dictated by system requirements. At VHF, however, where one wavelength may be 10 meters, neither the colinear nor parallel side-by-side antenna arrangement is practical because of the large separation required.

SUMMARY OF THE INVENTION

It is the primary object of the present invention to provide high interantenna isolation between closely spaced antennas.

A related object of the invention is to obtain a very high decoupling (e.g., 35 dB isolation) between antennas separated by only a fraction of a wavelength (over the operative frequency band) without significant impairment of the equatorial plane radiation pattern.

The achievement of the foregoing objects is based on significantly minimizing the radiation couping between cosited antennas by separating the antenna near-fields, and by suppressing extraneous parasitic rf currents on the outer conductors of the coaxial cable antenna feed lines.

In a preferred embodiment of the present invention two cosited omnidirectional biconical antennas are respectively tilted plus and minus 45 degrees (±45°) with respect to the vertical and, therefore, are 90 degrees with respect to each other to effect polarization mismatch and near-field decoupling. In combination with the described antennae orientation, a plurality of high impedance cable chokes are added in series with the coaxial cable antennae feed lines to suppress induced parasitic rf currents. The cable chokes increase and smooth the interantenna isolation by eliminating extraneous coupling due to scattering from the transmission lines.

BRIEF DESCRIPTION OF THE DRAWINGS

The invention will be more full appreciated from the following detailed description when the same is considered in connection with the accompanying drawings in which.

DETAILED DESCRIPTION

Figure 1:
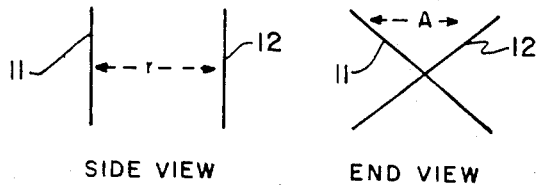
FIG. 1 is a simplified showing of two short dipoles (Hertz dipoles) in free space.

Free space radiation coupling establishes an upper bound for the achievable interantenna isolation. It can be controlled by antenna spacing and orientation. To establish this upper bound a simplified theoretical model consisting of two short dipoles (Hertz dipoles) may be resorted to. FIG. 1 shows Hertz dipoles 11 and 12 in free space. In the "end view" showing in FIG. 1 the dipole 12 is, of course, recessed by the distance r with respect to dipole 11.

Figure 2:
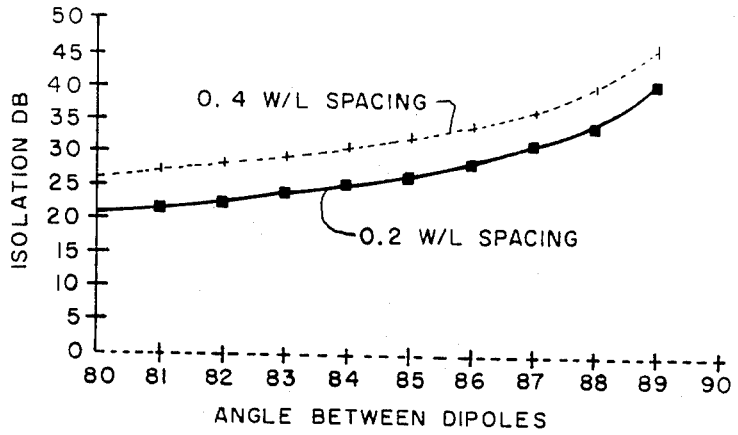
FIG. 2 illustrates the isolation between the Hertz dipoles arranged as shown in FIG. 1.

The interantenna isolation is defined as the fraction of the total power radiated ($P_T$) by one antenna which is intercepted by the other ($P_R$). The isolation between Hertz dipoles arranged as shown in FIG. 1 is given by:

$$P_R/P_T = 9/16\,(1/x^6 - 1/x^4 + 1/x^2)\cos^2 A \qquad (1)$$

Where $x = 2\pi r/2$, r is the spacing, λ is the free space wavelength, and A is the angle between the dipoles. This isolation is shown in FIG. 2 for wavelength spacings of 0.4 and 0.2. For spacing greater than 0.5 wavelength, the isolation is:

$$(P_R/P_T) = (9/16x^2)\cos^2 A \qquad (2)$$

with an error of less than 10%. The Friis transmission formula (see "Antennas Theory and Practice" by Schelkunoff Friis and, John Wiley and Sons (1952)) reduces to equation (2) when the antennas consist of current elements.

The theoretical model discussed above provides a good estimate of the achievable isolation between two dipoles in free space. In this model only radiation coupling was considered.

Scattering from the ground affects the antenna radiation patterns and the interantenna isolation. To determine these effects the known method-of-moments technique was used to model the antenna system. The solution was obtained by means of the Mini-Numerical Electromagnetics Code (MININEC); i.e., this antenna concept was simulated using the MININEC program (see "Microcomputer Tools for Communications Engineering" by S.T. Li et al, Artech House Inc. (1983)). MININEC solves for all rf currents in the radiating system and calculates input impedances and radiation patterns.

Figure 3:
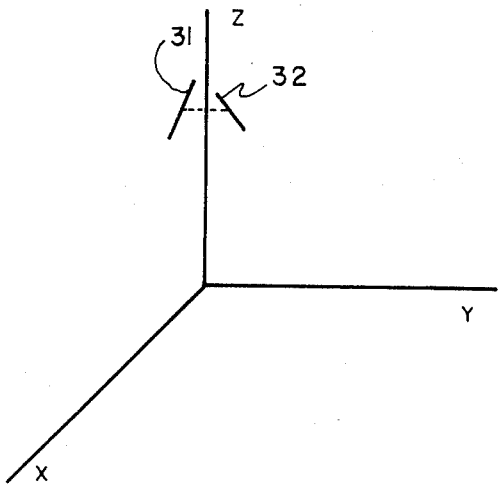
FIG. 3 illustrates an antenna system model consisting of a pair of half-wave dipoles over ground.

The antenna system modeled consists of a pair of half-wave dipoles 31 and 32 over ground; see FIG. 3. In order to include scattering from the transmission line, vertical and horizontal conductors were also incorporated in the computer model. The dipoles 31 and 32 are each angled 45° to the Z axis.

Figure 4:
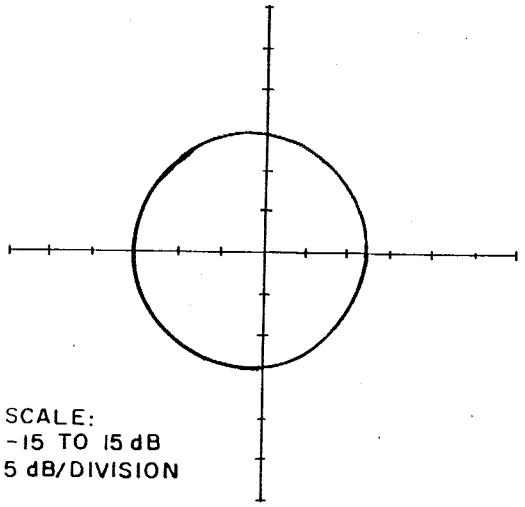
FIGS. 4–6 show calculated azimuthal radiation patterns of crossed half-wave dipoles over ground at 30, 60 and 90 MHz, respectively.
Figure 5:
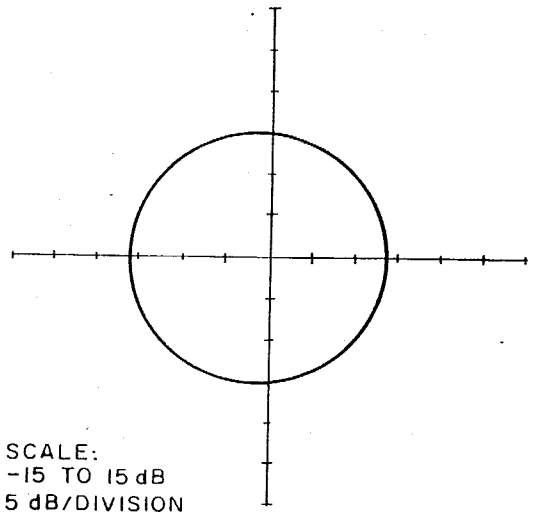
Figure 6:
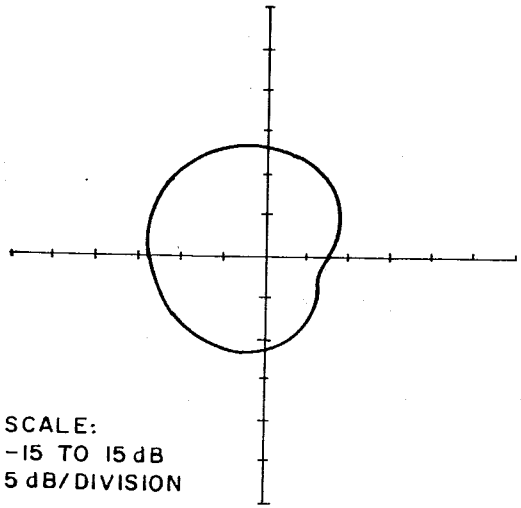

The calculated aximuthal radiation patterns of the E-field vertical component at 30, 60 and 90 MHz are shown in Figs. 4–6, respectively. At 30 MHz and at 60 MHz the patterns are circular within about +/−1.5 dB. Thus, the described dipole tilting has minimal effect on the radiation patterns at these frequencies. At 90 MHz, the radiation pattern varies by about +/−4 dB. This variation is attributed to ground reflections and the mixed polarization of the tilted dipoles. This pattern variation or distortion is still within acceptable limits, and, as will be evident to those skilled in the art, there are cases where this pattern variation may, in fact, be advantageous.

Figure 7:
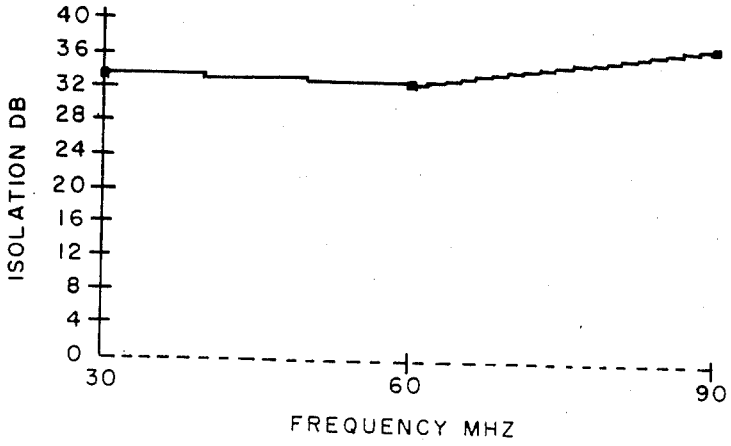
FIG. 7 shows the calculated isolation between crossed half-wave dipoles over ground.

The theoretical interdipole isolation obtained from MININEC is shown in FIG. 7. The isolation was calculated by means of:

$$(P_R/P_T)=\tfrac{1}{2}Re\,(V_R I_R^*)/\tfrac{1}{2}Re\,(V_T I_T^*) \qquad (3)$$

Where $V_R$ is the receiving antenna load voltage, $I_R$ is the load current, $V_T(I_T)$ are the transmitting antenna input voltage (current), and Re means the real part of ( . . . ).

Figure 8:
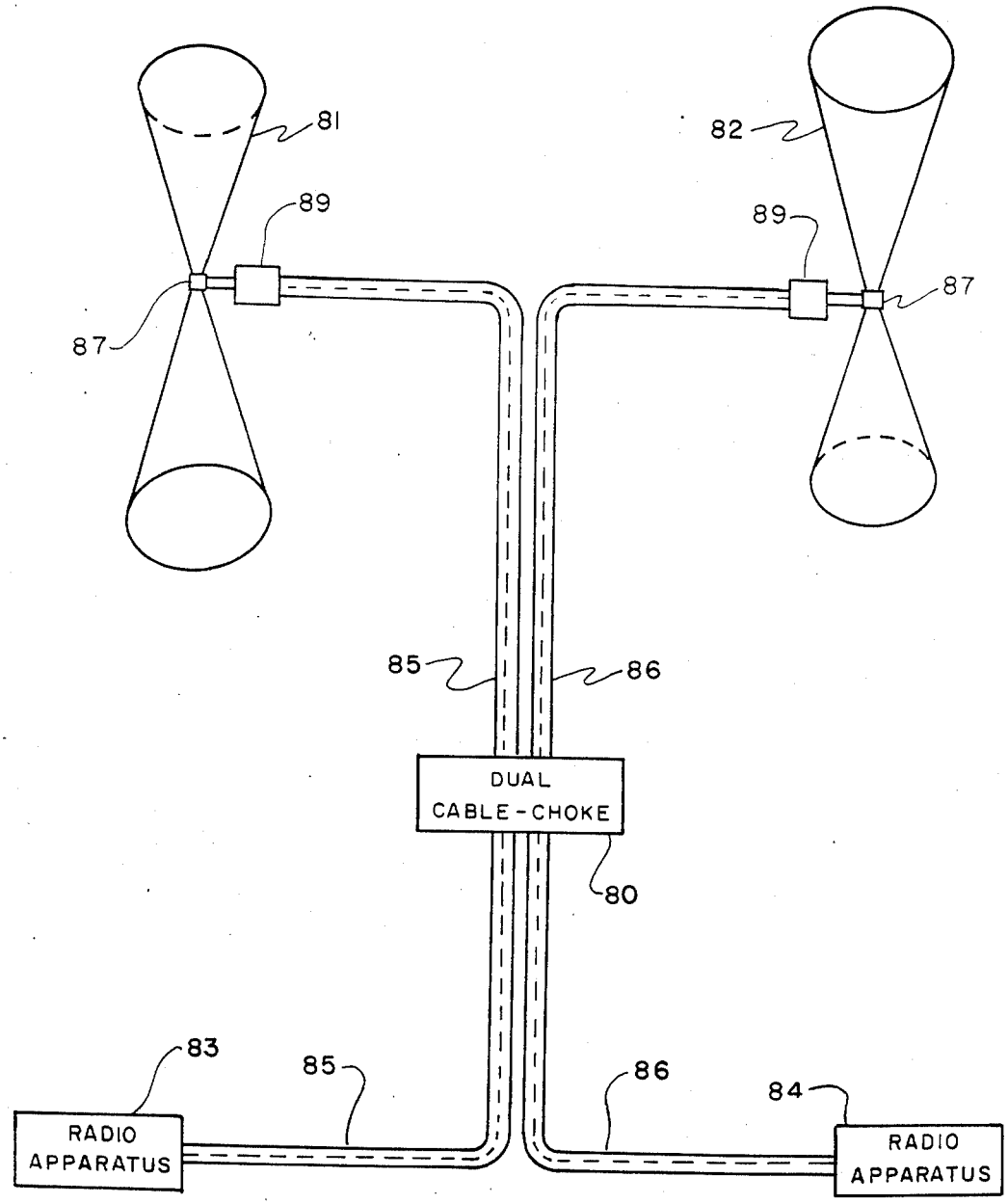
FIG. 8 is a diagram of a cross-polarized biconical antenna assembly in accordance with the present invention.
Figure 9:
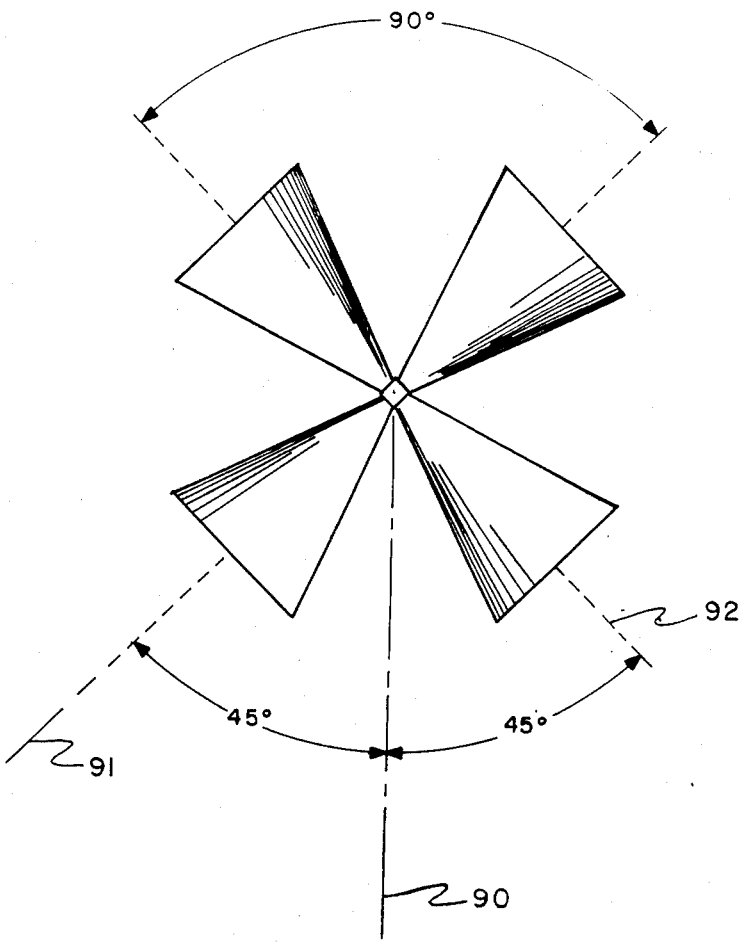
FIG. 9 is an edge or end view of the biconical antennas of FIG. 8.

The foregoing theoretical analysis of the principles of the present invention has been verified by a reduction-to-practice of a preferred embodiment of the invention, which is diagrammatically illustrated in FIG. 8 of the drawings. The broadband omnidirectional antenna system of FIG. 8 comprises a pair of cosited biconical antennas 81 and 82. The antennas 81 and 82 were horizontally separated 3.7 meters, with operation in the VHF (30–88 MHz) frequency band. It is to be understood, however, that the invention is in no way limited to any exact antenna separation and it is applicable to other and different frequency bands. An interantenna isolation exceeding 30 dB from 30 to 90 MHz can be achieved for an antenna spacing (s) equal to, or less than, one-half wavelength ($s<\frac{1}{2}\lambda$). Maximum isolation between the antennas is obtained when they are: (a) tilted plus and minus 45 degrees (±45°) with respect to the vertical; and (b) the antennas are perpendicular (90°) to each other. This antenna orientation is diagrammatically illustrated in FIG. 9 of the drawings. The dot-dash line 90° represents the vertical and the axes 91 and 92 of the biconical antennas are each displaced 45° from the vertical. Also, as shown in FIG. 9 the axes 91 and 92 are perpendicular (90°) to each other. This configuration will effect maximum polarization mismatch and near field separation.

Biconical antennas are, of course, known in the art. Such antennas are typically comprised of flat sheet metal, or of wire mesh, or they are built of fanned wires or "whiskers", all in a biconic shape. It is also common practice to use feed cones of flat sheet metal in combination with extended whiskers or wires.

Returning now to FIG. 8, radio apparatus 83 and 84 are respectively coupled to the biconical antennas 81 and 82 by means of transmission lines or feed lines 85 and 86. The radio apparatus may comprise a transmitter and a receiver, respectively, or a pair of transceivers-possibly operating in a frequency-hopping mode, etc. The exact nature of the radio apparatus has little to do with the present invention. The transmission lines 85 and 86 comprise coaxial cables of conventional design which are coupled to their respective antennas 81 and 82 in accordance with a standard and known technique. The reference numeral 87 designates an insulator which is typically disposed between the two cones of a biconical antenna. Because the pair of antennas can be closely spaced, only a single vertical support or mast (not shown) is required. At the top of the mast (approximately 9 meters above ground), a horizontal fiberglass boom (not shown) supports the antennas at the two ends thereof. The coaxial cables 85 & 86 are strung along and secured to these vertical and horizontal supports. To maintain high isolation the dual antenna assembly should be installed in a clear area away from buildings and other antennas.

In addition to the above-described antennae orientation and in combination therewith, three high impedance cable chokes 80, 88 and 89 are added in series with the coaxial cable transmission lines to suppress induced parasitic rf currents. The cable chokes increase and smooth the interantenna isolation by eliminating extraneous coupling due to scattering from the transmission feed lines. The choke 80 is a dual cable choke and chokes 88 and 89 are single port chokes. The chokes 88 and 89 should preferably be located as close as possible to the point of connection of the feed lines 85 and 86 to the respective antennas 81 and 82 to create a high impedance point at said point of connection. The cable chokes 80, 88 and 89 are similar to the cable chokes disclosed in detail in the patents to D. V. Campbell (a co-inventor of the present invention) and J. J. Arnold, U.S. Pat. Nos. 3,879,735 and 4,149,170, issued Apr. 22, 1975 and Apr. 10, 1979, respectively.

Figure 10:
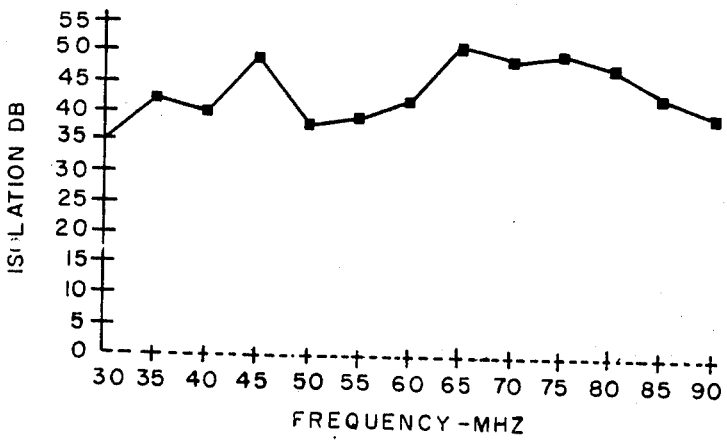
FIG. 10 shows measured isolation between crossed biconical antennas over ground.

The measured interantenna isolation for the FIG. 8 antenna system is shown in FIG. 10. The isolation varied from 35 decibels to 50 decibels over the 30 to 90 MHz frequency range.

The principles of the present invention are useful in particular for point-to-point radio communication between fixed stations (to achieve high transmit-receive isolation at each station). It may also be used for a fixed base station communicting with several mobile subscribers. In this case, the skewed antenna arrangement would be used for the base station while the mobile terminals would transmit and receive at the same (vertical or horizontal) polarization. The present invention is not limited to biconical antennas; the invention is applicable to linear antennas in general and could be used for cosited Hertz dipoles, for example. It is to be understood, therefore, that the foregoing disclosure relates to only a particular embodiment of the invention and that numerous modifications or alterations may be made therein without departing from the spirit and scope of the invention.

What is claimed is:

1. A broad band omnidirectional antenna system comprising two cosited dipole antennas, said antennas being tilted plus and minus forty-five degrees with respect to the vertical so that their axes are ninety degrees or perpendicular with respect to each other, and a plurality of high impedance cable chokes added in series with the antennae feed lines to suppress induced parasitic rf currents.

2. An antenna system as defined in claim 1 wherein said two cosited dipole antennas are biconical antennas.

3. An antenna system as defined in claim 2 wherein the spacing (s) between said two cosited biconical antennas is equal to, or less than, one-half wavelength ($s\leqq\frac{1}{2}\lambda$) over the operative frequency range.

4. An antenna system as defined in claim 3 wherein said operative frequency range is 30 to 90 MHz (VHF).

5. An antenna system as defined in claim 4 wherein said cable chokes comprise a dual cable choke and a pair of single port chokes each located as close as possible to the point of connecton of an antenna feed line to a respective antenna.

6. In combination, two cosited omnidirectional biconical antennas, said antennas being respectively tilted plus and minus forty five degrees (±45°) with respect to the vertical so that their axes are ninety degrees (90°) with respect to each other, the spacing (s) between said two cosited biconical antennas being equal to, or less than, one-half wavelength ($s \leqq \frac{1}{2}\lambda$) over the VHF range, a coaxial cable antenna feed line for each of said two antennas, a dual cable choke connected in series with the pair of antenna feed lines, and a single port choke connected in series with each of said antenna feed lines and as close as possible to the point of connection of an antenna feed line to a respective antenna, the series connected chokes serving to suppress induced parasitic rf currents.

* * * * *